US010947087B2

(12) United States Patent
Herkel et al.

(10) Patent No.: US 10,947,087 B2
(45) Date of Patent: Mar. 16, 2021

(54) ELEVATOR SAFETY SYSTEM AND METHOD OF OPERATING AN ELEVATOR SYSTEM

(71) Applicant: Otis Elevator Company, Farmington, CT (US)

(72) Inventors: Peter Herkel, Berlin (DE); Dirk H. Tegtmeier, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 601 days.

(21) Appl. No.: 15/841,758

(22) Filed: Dec. 14, 2017

(65) Prior Publication Data

US 2018/0162692 A1 Jun. 14, 2018

(30) Foreign Application Priority Data

Dec. 14, 2016 (EP) ..... 16204044

(51) Int. Cl.
*B66B 5/00* (2006.01)
*B66B 13/22* (2006.01)
(Continued)

(52) U.S. Cl.
CPC ..... *B66B 5/0031* (2013.01); *B66B 1/3492* (2013.01); *B66B 1/36* (2013.01);
(Continued)

(58) Field of Classification Search
CPC ... B66B 5/0031; B66B 5/0043; B66B 1/3492; B66B 1/36; B66B 1/50; B66B 5/0068; B66B 11/0005; B66B 13/22
(Continued)

(56) References Cited

U.S. PATENT DOCUMENTS 4,498,033 A * 2/1985 Aihara ..... G05B 19/4163 318/261
5,806,633 A 9/1998 Macuga
(Continued)

FOREIGN PATENT DOCUMENTS

CN 201058781 Y 5/2008
CN 201825610 U 5/2011
(Continued)

OTHER PUBLICATIONS

European Search Report for application EP 16204044.8, dated Jun. 2, 2017, 7 pages.

*Primary Examiner* — David S Warren
(74) *Attorney, Agent, or Firm* — Cantor Colburn LLP

(57) ABSTRACT

An elevator system (1) comprises: a hoistway (4) extending between a plurality of landings (8, 9); at least one hoistway door (10, 11) allowing access to the hoistway (4); an elevator car (6), which is configured to move along the hoistway (4); at least one safety (16), which is attached to the elevator car (6) and configured to stop any movement of the elevator car (6) when activated; an electronic safety actuator (18), which is configured to activate and deactivate the at least one safety (16); and a door safety switch (20), which is configured to monitor the at least one hoistway door (10, 11) and which is connected with the electronic safety actuator in order to allow activating the at least one safety (16), if the door safety switch (20) detects that the at least one hoistway door (10, 11) is not closed.

10 Claims, 3 Drawing Sheets

Figure 1:
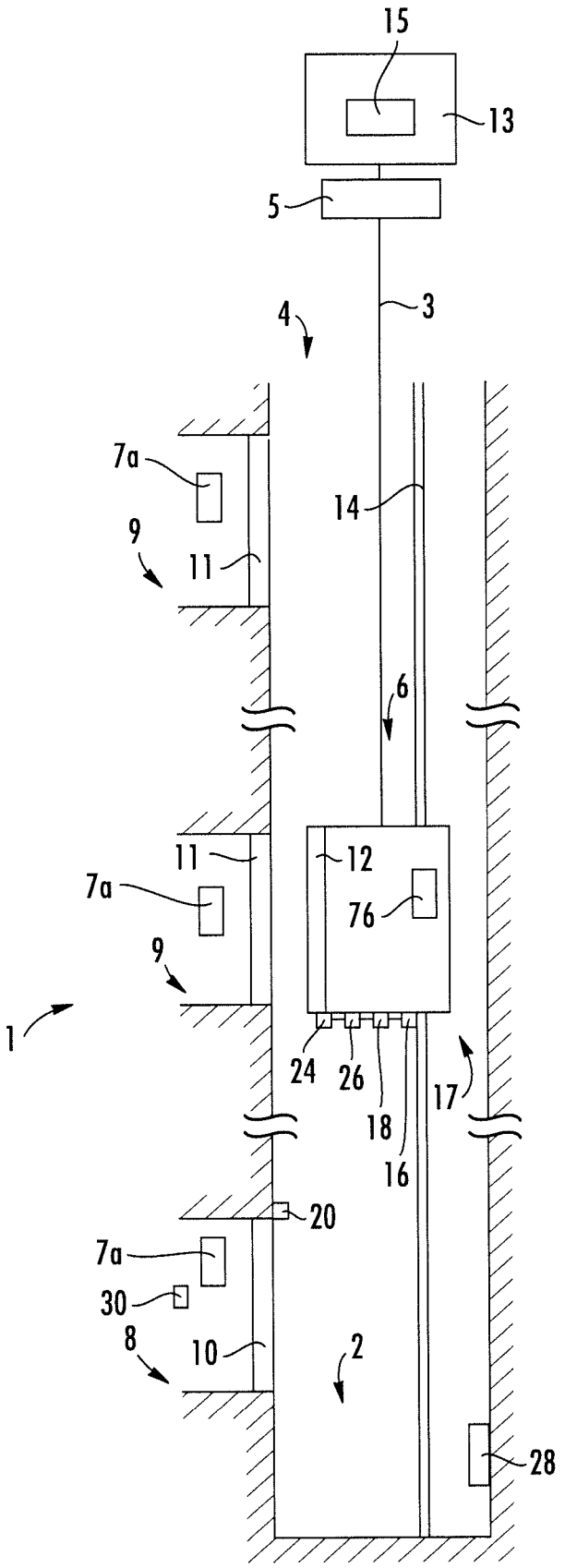

(51) Int. Cl.

| | |
|---|---|
| ***B66B 1/34*** | (2006.01) |
| ***B66B 11/00*** | (2006.01) |
| ***B66B 1/50*** | (2006.01) |
| ***B66B 1/36*** | (2006.01) |

(52) U.S. Cl.
CPC ..... *B66B 1/50* (2013.01); *B66B 5/0043* (2013.01); *B66B 5/0068* (2013.01); *B66B 11/0005* (2013.01); *B66B 13/22* (2013.01)

(58) Field of Classification Search
USPC ..... 187/393
See application file for complete search history.

(56) References Cited

U.S. PATENT DOCUMENTS

| | | | | |
|---|---|---|---|---|
| 7,137,484 | B2 * | 11/2006 | Martin | B66B 17/34 187/354 |
| 7,650,969 | B2 | 1/2010 | Monzon et al. | |
| 7,832,526 | B2 | 11/2010 | Sirigu | |
| 7,905,330 | B2 * | 3/2011 | Jahkonen | B66B 5/0018 187/391 |
| 8,028,808 | B2 | 10/2011 | Gonzalez et al. | |
| 8,118,140 | B2 * | 2/2012 | Kattainen | B66B 1/32 187/391 |
| 8,136,637 | B2 | 3/2012 | Coquerelle et al. | |
| 8,162,108 | B2 | 4/2012 | Sirigu et al. | |
| 8,261,885 | B2 | 9/2012 | Ketoviita et al. | |
| 8,887,873 | B2 * | 11/2014 | Washio | B66B 5/0018 187/393 |
| 9,422,133 | B2 * | 8/2016 | Rebillard | B66B 1/40 |
| 9,452,909 | B2 | 9/2016 | Taylor et al. | |
| 9,809,420 | B2 | 11/2017 | Fauconnet et al. | |
| 9,975,733 | B2 * | 5/2018 | Cunningham | B66B 5/18 |
| 10,189,676 | B2 * | 1/2019 | Hovi | B66B 5/027 |
| 10,562,738 | B2 * | 2/2020 | Sonnenmoser | B66B 1/3438 |
| 2003/0168287 | A1 * | 9/2003 | Helmle | B66B 9/02 187/288 |
| 2006/0201752 | A1 * | 9/2006 | Helstrom | B66B 1/32 187/313 |
| 2009/0255762 | A1 | 10/2009 | Ketonen et al. | |
| 2010/0051391 | A1 * | 3/2010 | Jahkonen | B66B 13/22 187/393 |
| 2011/0162913 | A1 * | 7/2011 | Kattainen | B66B 1/32 187/280 |
| 2012/0043166 | A1 * | 2/2012 | Washio | B66B 5/06 187/393 |
| 2012/0073909 | A1 * | 3/2012 | Kondo | B66B 1/32 187/247 |
| 2013/0025975 | A1 | 1/2013 | Guillot et al. | |
| 2015/0251876 | A1 | 9/2015 | Fauconnet et al. | |
| 2016/0068368 | A1 * | 3/2016 | Hovi | B66B 1/343 187/247 |
| 2016/0214834 | A1 * | 7/2016 | Cunningham | B66B 5/18 |
| 2017/0057789 | A1 * | 3/2017 | Witczak | B66B 11/0273 |
| 2017/0174474 | A1 * | 6/2017 | Aitamurto | B66B 5/005 |
| 2017/0334678 | A1 * | 11/2017 | Sonnenmoser | B66B 5/0031 |
| 2018/0162692 | A1 * | 6/2018 | Herkel | B66B 5/0068 |
| 2018/0186600 | A1 * | 7/2018 | Kramer | B66B 13/22 |
| 2020/0130986 | A1 * | 4/2020 | Michel | B66B 1/3407 |

FOREIGN PATENT DOCUMENTS

| | | | |
|---|---|---|---|
| CN | 204400378 | U | 6/2015 |
| EP | 1118574 | A2 | 7/2001 |
| EP | 2033927 | A1 | 3/2009 |
| EP | 2488435 | B1 | 6/2013 |
| EP | 1817251 | B1 | 3/2015 |
| WO | 2013025185 | A1 | 2/2013 |

* cited by examiner

ELEVATOR SAFETY SYSTEM AND METHOD OF OPERATING AN ELEVATOR SYSTEM

The invention relates to an elevator safety system and to a method of operating an elevator system.

Elevator systems usually have a pit formed at the bottom of the hoistway.

Occasionally a mechanic needs to enter the hoistway for inspecting, maintaining and/or repairing the elevator system. In this situation, measures need to be taken in order to avoid that the mechanic present in the pit is hit or squeezed by the elevator car. This is particularly important if the elevator system is equipped with a low pit, e.g. a pit having a height of less than 2 m.

Preventing any movement of the elevator car as long as a person, in particular a mechanic, is present in the pit is not always possible, as it may be necessary to move the elevator car in the course of the inspection, maintenance and/or repair.

A known option is to provide a movable prop within the pit. When a mechanic enters the pit, the prop is erected manually or triggered by relay circuitry into an activated position in which it provides an emergency rescue space below the elevator car. This solution, however, requires significant additional components and wiring effort in order to assure safety of persons entering the pit.

It therefore would be beneficial to provide an improved elevator system which ensures the safety of persons residing within the pit with less structural effort.

According to an exemplary embodiment of the invention an elevator system comprises: a hoistway extending between a plurality of landings; at least one hoistway door allowing access to the hoistway; an elevator car, which is configured to move along the hoistway; at least one safety, which is attached to the elevator car and configured to stop any movement of the elevator car when activated; an electronic safety actuator, which is configured to selectively activate and deactivate the at least one safety; and a door safety switch, which is configured to monitor the at least one hoistway door, wherein the door safety switch is connected with the electronic safety actuator and configured to set the electronic safety actuator to an activated condition if the door safety switch detects that the at least one hoistway door is not closed. When set to the activated condition, the electronic safety actuator allows activating the at least one safety according to a predefined condition.

Depending on said predefined condition, which in particular may be related to the current vertical position (height) of the elevator car within the hoistway, the at least one safety may be activated immediately in order to stop the moving elevator car. Alternatively, in particular in a situation in which the elevator car is located above a predetermined height within the hoistway, the activation of the at least one safety may be postponed until the elevator car has stopped. In this case, activating of the at least one safety reliably prevents that the elevator car will start moving again.

According to an exemplary embodiment of the invention a method of operating such an elevator system comprises: monitoring the at least one hoistway door using the door safety switch and activating the at least one safety via the electronic safety actuator, if the door safety switch detects that the monitored hoistway door is not closed.

Modern elevator systems are usually equipped with an electronic safety actuator (ESA), which is configured to control, particularly to activate and deactivate, the at least one safety of the elevator system in case of an emergency situation. Exemplary embodiments of the invention use said electronic safety actuator for ensuring the safety of persons residing within the pit. A door safety switch, which monitors a hoistway door providing access to the pit, is connected with the electronic safety actuator in order to provide the information whether the hoistway door is open or closed to the electronic safety actuator. The electronic safety actuator is configured to activate at least one safety of the elevator system, if said hoistway door is not properly closed, in order to avoid that the elevator car moves into positions which are close to the open hoistway door which would endanger persons having entered into the hoistway via said hoistway door.

As a result, exemplary embodiments of the invention ensure the safety of persons present in the hoistway, particularly in the pit, of an elevator system with only small additional structural effort.

In the following, an exemplary embodiment of the invention is described with reference to the enclosed figures.

FIG. 1 schematically depicts an elevator system according to an exemplary embodiment of the invention.

Figure 2:
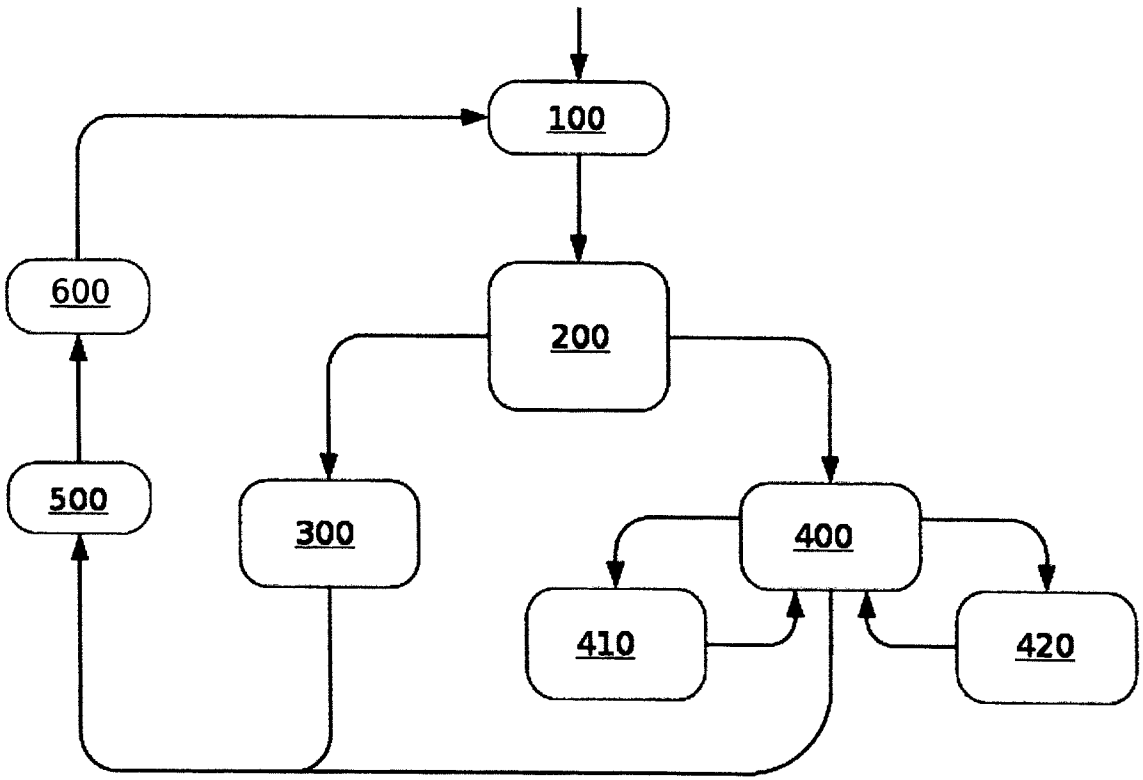

FIG. 2 is a flow diagram illustrating a method of operating an elevator system according to an exemplary embodiment of the invention in a maintenance mode.

Figure 3C:
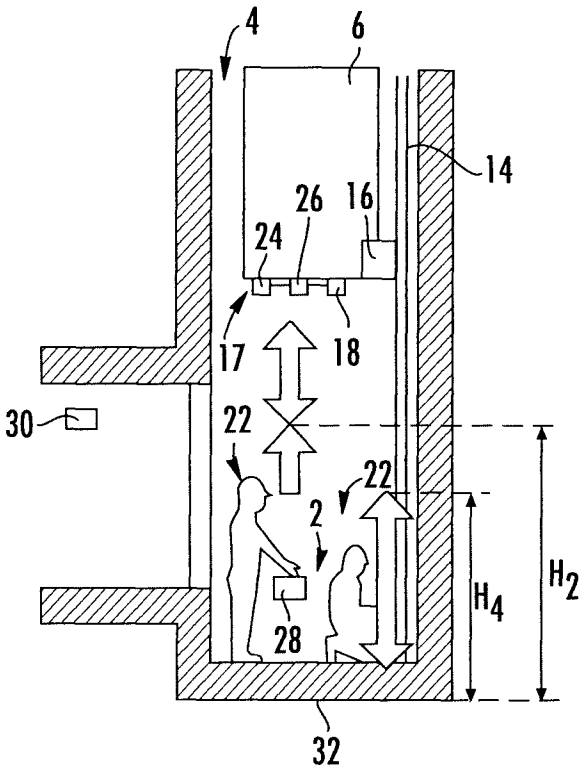
Figure 3B:
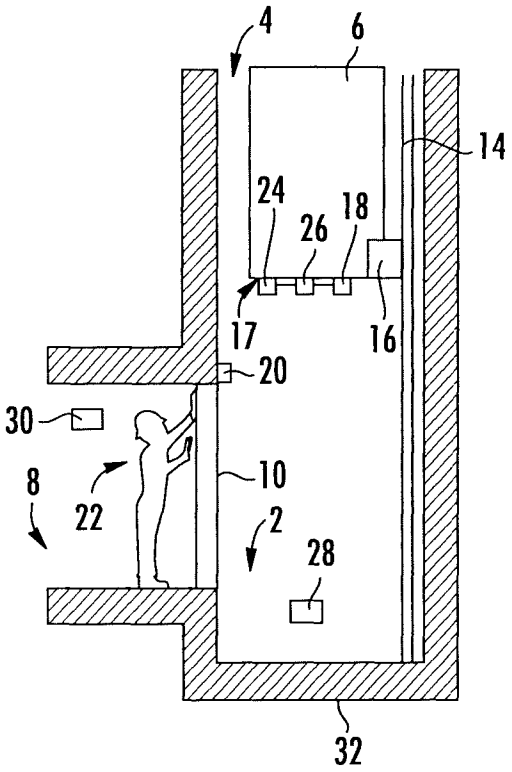
Figure 3A:
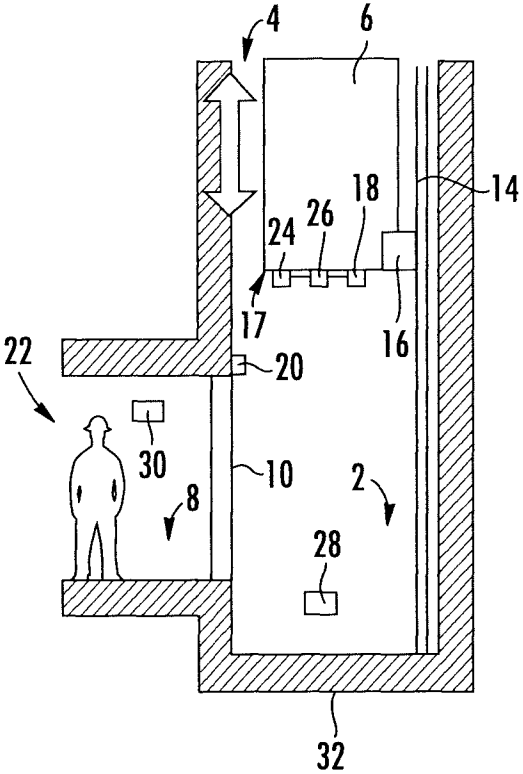

FIGS. 3*a*, 3*b* and 3*c* illustrate a lower portion of the hoistway during selected steps of said method.

FIG. 1 schematically depicts an elevator system 1 according to an exemplary embodiment of the invention.

The elevator system 1 comprises an elevator car 6 which is movably suspended within a hoistway 4. The hoistway 4 extends between a plurality of landings 8, 9, which are located on different floors. At least one guide rail 14, which is configured to guide the elevator car 6 when moving along the hoistway 4, extends along the length (height) of the hoistway 4. A pit 2 is formed at a lower portion of the hoistway 14.

Each landing 8, 9 is provided with a hoistway door 10, 11, and the elevator car 6 is provided with a corresponding elevator car door 12 for allowing passengers to transfer between a landing 8, 9 and the interior of the elevator car 6 when the elevator car 6 is positioned at the respective landing 8, 9.

The elevator car 6 is movably suspended by means of a tension member 3. The tension member 3, for example a rope or belt, is connected to an elevator drive unit 5, which is configured to drive the tension member 3 in order to move the elevator car 6 along the height of the hoistway 4 between the plurality of landings 8. The exemplary embodiment shown in FIG. 1 uses a 1:1 roping for suspending the elevator car 6. The skilled person, however, easily understands that the type of the roping is not essential for the invention and that different kinds of roping, e.g. a 2:1 roping, may be used as well. The elevator system 1 may use a counterweight (not shown) or not. The elevator drive unit 5 may be any form of drive used in the art, e.g. a traction drive, a hydraulic drive or a linear drive. The elevator system 1 may have a machine room or may be a machine room-less elevator system. The elevator system 1 may use a tension member 3, as it is shown in FIG. 1, or it may be an elevator system without a tension member 3, comprising e.g. a hydraulic drive or a linear drive (not shown).

The elevator drive unit 5 is controlled by an elevator control unit 13 for moving the elevator car 6 along the hoistway 4 between the different landings 8, 9.

Input to the elevator control unit 13 may be provided via landing control panels 7*a*, which are provided on each landing 8, 9 close to the hoistway doors 10, 11 and/or via a car operation panel 7*b* provided inside the elevator car 6.

The landing control panels 7*a* and the car operation panel 7*b* may be connected to the elevator control unit 13 by means of electrical lines, which are not shown in FIG. 1, in particular by an electric bus, or by means of wireless data connections.

The elevator car 6 is equipped with at least one safety 16. The at least one safety 16 is configured to engage with the at least one guiderail 14, when activated, in order to prevent any further movement of the elevator car 6. The at least one safety 16 in particular is functionally connected with an electronic safety actuator (ESA) 18, which is configured to control, in particular activate and deactivate, the at least one safety 16.

The electronic safety actuator 18 is connected with at least one sensor 24 which is configured to detect an abnormal state (malfunction) of the elevator system 1, particularly an overspeed condition of the elevator car 6. Thus, the electronic safety actuator 18 is able to activate the at least one safety 16 if such an abnormal state (malfunction) of the elevator system 1 is detected. The electronic safety actuator 18 in particular may be connected with a speed sensor 24 and/or a governor (not shown) configured to measure the speed of the elevator car 6 in order to activate the at least one safety 16 in case the speed of the elevator car 6 exceeds a predetermined threshold.

The elevator car 6 and/or the elevator drive unit 5 further may be equipped with a position sensor 26, which is configured to determine the current vertical position of the elevator car 6 within the hoistway 4. Any type of position sensor 26 may be used.

Optionally, the electronic safety actuator 18 may be configured to activate the at least one safety 16 every time the elevator car 6 has stopped at one of the landings 8, 9.

Although the safety 16, the electronic safety actuator 18 and the sensors 24, 26 are depicted in a position below a bottom 17 of the elevator car 6, the skilled person understands that each of the safety 16, the electronic safety actuator 18 and the sensors 24, 26 may be provided on top of or at a sidewall of the elevator car 6. The skilled person will further understand that additional sensors 24, 26 and/or more than one safety 16 may be used.

The elevator system 1 further comprises a door safety switch 20, which is arranged at the hoistway door 10 located at the lowest landing 8 (lowest landing door 10) and which is configured to detect whether said lowest landing door 10 is open or closed.

The door safety switch 20 is connected via at least one electrical wire (not shown) or by a wireless connection with the electronic safety actuator 18. This connection allows the door safety switch 20 to transmit the information whether the lowest landing door 10 is open or closed to the electronic safety actuator 18.

An inspection mode control unit 28 is provided within the pit 2. A reset switch 30 is arranged at the lowest landing 8 outside the hoistway 4. The purpose and the functionality of the inspection mode control unit 28 and the reset switch 30 will be described further below with reference to FIGS. 2 and 3.

In the following, a method of operating an elevator system 1 according to an exemplary embodiment of the invention is explained in more detail referring to the flow diagram shown in FIG. 2 and with respect to FIGS. 3*a*, 3*b*, and 3*c* 3 depicting a lower portion of the hoistway 4, respectively.

At the beginning (step 100) the elevator system 1 is in a normal operation mode.

When a person, in particular a mechanic 22, (see FIG. 3*a*) desires to enter into the pit 2 of the hoistway 4, e.g. for inspection, maintenance or repair, he opens the lowest hoistway door 10 (step 200), while the elevator car 6 is located in a position spaced apart from the lowest landing 8 (see FIG. 3*b*). The mechanic 22 may use a special tool or key (not shown) for opening the lowest hoistway door 10.

The door safety switch 20, which is located at the lowest hoistway door 10, detects that the lowest hoistway door 10 has been opened and provides a corresponding signal to the electronic safety actuator 18. Said signal is transmitted via a wired or wireless connection, which is not shown in the figures. Said signal may be transmitted via the elevator control unit 13, particularly via a safety control unit 15 which is part of the elevator control unit 13.

Additionally, a position sensor 26, which is located at the elevator car 6, provides information indicating the vertical position (height) of the elevator car 6 within the hoistway 4 to the electronic safety actuator 18.

Alternatively, the position sensor 26 may be located at the elevator drive unit 5, e.g. in the form of a shaft encoder, or at least partly within the hoistway 4, e.g. in the form of a coded tape, which is detected by a detector attached to the elevator car 6.

When the door safety switch 20 indicates that the lowest hoistway door 10 has been opened, the electronic safety actuator 18 determines based on a signal received from the position sensor 26 whether the bottom 17 of the elevator car 6 is positioned within the pit area, i.e. within the lowest portion of the hoistway 4 extending from a bottom 32 of the hoistway 4 (bottom of the pit 2) up to a predetermined first distance (height) H1 from the bottom 32 of the hoistway 4 (see FIG. 3*c*).

In case the bottom 17 of the elevator car 6 is positioned within said pit area, i.e. within the predetermined first distance H1, which is an example for a first predefined condition, the electronic safety actuator 18 immediately triggers I activates the at least one safety 16 (step 300) stopping and preventing any movement of the elevator car 6 in order to ensure the safety of the mechanic 22 which has entered or is about to enter the pit 2.

In case the bottom 17 of the elevator car 6 is positioned above the pit area, i.e. outside the predetermined first distance H1 from the bottom 32 of the hoistway 4, so that the first predefined condition is not fulfilled, the at least one safety 16 is triggered I activated only after the elevator car 6 has been stopped by the elevator drive 5 (step 400). The condition that the elevator car 6 does not move is an example for a second predefined condition. Of course, in such a situation, the at least one safety 16 is triggered I activated as soon as the elevator car 6 moves such that the bottom 17 of the elevator car 6 is located below the predetermined first distance H1 so that the first predefined condition is fulfilled. I.e. the at least one safety 16 is triggered I activated if at least one of the first and second predefined conditions is fulfilled.

Stopping the movement of the elevator car 6 by activating the at least one safety 16 is uncomfortable to passengers present within the elevator car. It further may cause heavy wear of the components of the elevator system 1. Therefore it is preferable to stop the movement of the elevator car 6 by means of the elevator drive 5 before the bottom 17 of the elevator car 6 reaches the predetermined first distance H1. This allows to activate the at least one safety 16 only after the elevator car 6 has stopped in order to prevent any further movement of the elevator car 6. Of course, the at least one safety 16 is also activated in an emergency situation, in which stopping the movement of the elevator car 6 by means of the elevator drive has failed and the bottom 17 of the elevator car 6 moves below the predetermined first distance H1.

The inspection mode control unit 28, which is provided within the pit 2, allows the mechanic 22 to release the at least one safety 16 and to move the elevator car 6 as it may be necessary for inspection, maintenance and/or repair.

However, in case the bottom 17 of the elevator car 6 is positioned closer than a predetermined second distance (height) H2, which is larger than the first distance H1, from the bottom 32 of the hoistway 4 (step 410), the electronic safety actuator 18 allows only an upward motion, i.e. a motion away from the bottom 32 of the hoistway 4. This prevents that the mechanic 22 is hit or squeezed by the elevator car 6.

If the bottom 17 of the elevator car 6 is positioned outside said second distance H2, the mechanic 22 is allowed to move the elevator car 6 in both directions, i.e. upwards away from the bottom 32 of the hoistway 4 and downwards closer to the bottom 32 of the hoistway 4 (step 420).

After the mechanic 22 has finished his work within the pit 2, left the pit 2 and closed the lowest landing door 10, he activates the reset switch 30 provided at the lowest landing 8 in order to confirm that he has left the pit 2 (step 500). Alternatively, the mechanic 22 may confirm that he has left the pit 2 by removing his tool or key from a lock (not shown) which is used for locking and unlocking the lowest landing door 10. In order to enhance the safety, the lock may be configured so that the tool or key may be removed only after the lowest landing door 10 has been closed and locked.

After the mechanic 22 has confirmed that he has left the pit 2, the electronic safety actuator 18 releases (deactivates) the at least one safety 16 (step 600) and the elevator system 1 returns to normal operation.

A number of optional features are set out in the following. These features may be realized in particular embodiments, alone or in combination with any of the other features.

The door safety switch may be assigned to a hoistway door which is located at a lowest landing among the plurality of landings. The door safety switch particularly may be configured to monitor the hoistway door located at the lowest landing. Usually, the hoistway door located at a lowest landing is used for entering into the pit. Thus, monitoring the hoistway door located at the lowest landing allows to effectively monitor whether a person is about to enter into the pit.

The electronic safety actuator particularly may be configured to activate the at least one safety while the elevator car is moving in order to stop movement of the elevator car in order to prevent a person present in the pit from being hit or squeezed by the moving elevator car.

The electronic safety actuator may be configured to activate the at least one safety immediately when the door safety switch detects that the at least one hoistway door is not closed.

The elevator system may further comprise a position sensor which is configured to detect the position of the elevator car within the hoistway. In such a configuration the electronic safety actuator may be configured to activate the at least one safety to stop any movement of the elevator car, if the door safety switch detects that the at least one hoistway door is not closed and the position sensor detects that the bottom of the elevator car is positioned within a predetermined first distance from the at least one hoistway door I bottom of the hoistway.

In such a configuration, the elevator car may be allowed to move if it is located in an area which is spaced apart from the at least one hoistway door I bottom of the hoistway far enough so that there is no risk that a person present in the hoistway, in particular within the pit, is hit by the elevator car. However, the at least one safety may be activated for stopping any further movement of the elevator car if the elevator car comes close to the at least one hoistway door I bottom of the hoistway so that any further movement of the elevator car would be dangerous for a person residing within the hoistway.

An inspection mode control unit may be located within the pit and the electronic safety actuator may be configured to allow controlling movement of the elevator car in an inspection mode by via the inspection mode control unit.

The electronic safety actuator may be configured to activate the at least one safety only after the elevator car has stopped. This avoids a fast and hard stop of the elevator car as it is caused by activating the at least one safety. A fast and hard stop of the elevator car, as it is caused by activating the at least one safety, is uncomfortable to the passengers and may cause heavy wear of the components of the elevator system. Stopping the elevator car by activating the at least one safety therefore should be avoided unless it is necessary in an emergency situation, in particular in a situation in which it is not possible to stop the elevator car by means of the elevator drive.

The electronic safety actuator in particular may be configured to activate the at least one safety after the elevator car has stopped, if the door safety switch detects that the at least one hoistway door is not closed and the position sensor detects that the bottom of the elevator car is positioned outside the predetermined first distance from the at least one hoistway door.

If the bottom of the elevator car is positioned outside the predetermined first distance from the at least one hoistway door, it is not necessary to stop the movement of the elevator car immediately. Thus, it is sufficient to activate the at least one safety after the elevator car has stopped. Activating the at least one safety only after the elevator car has stopped reduces the wear of the at least one safety, as the at least one safety is used only for holding the elevator car in a fixed position but not for braking a moving elevator car.

The electronic safety actuator further may be configured to activate the at least one safety every time the elevator car has stopped, i.e. also in normal operation, in order to avoid any undesired movement of the elevator car. This improves the security of the elevator system even further.

The electronic safety actuator may be configured to allow releasing the at least one safety after it has been activated for moving the elevator car along the hoistway in an inspection mode.

The electronic safety actuator in particular may be configured to allow releasing the at least one safety for moving the elevator car in a direction away from the at least one hoistway door and/or from the bottom of the hoistway, after the at least one safety has been activated. Moving the elevator car in a direction away from the at least one hoistway door and/or from the bottom of the hoistway does not result in any risk for a person present below the elevator car and therefore may be allowed for inspection, maintenance and/or repair.

After the at least one safety has been activated, the electronic safety actuator may be configured to allow releasing the at least one safety and moving the elevator car in a direction towards the at least one hoistway door, if the position sensor detects that the distance of the bottom of the elevator car from the at least one hoistway door and/or the bottom of the hoistway is outside a predetermined second distance which is larger than the predetermined first distance. If the bottom of the elevator car is positioned outside the predetermined second distance from the at least one hoistway door and/or the bottom of the hoistway, the elevator car may be moved towards the at least one hoistway door and/or the bottom of the hoistway without causing a risk for a person present below the elevator car. Thus, such a movement may be allowed for inspection, maintenance and/or repair.

While the invention has been described with reference to exemplary embodiments, it will be understood by those skilled in the art that various changes may be made and equivalents may be substituted for elements thereof without departing from the scope of the invention. In addition many modifications may be made to adopt a particular situation or material to the teachings of the invention without departing from the essential scope thereof. Therefore, it is intended that the invention not be limited to the particular embodiment disclosed, but that the invention include all embodiments falling within the scope of the claims.

REFERENCES

1 elevator system
2 pit of the hoistway
3 tension member
4 hoistway
5 elevator drive
6 elevator car
? landing control panel
7 car operation panel
8 lowest landing
9 landings
1 hoistway door located at a lowest landing (lowest landing
1 hoistway door
1 elevator car door
1 elevator control unit
1 guide rail
1 safety control unit
1 safety
1 bottom of the elevator car
1 electronic safety actuator
2 door safety switch
2 mechanic
2 speed sensor
2 position sensor
2 inspection mode control unit
3 reset switch
3 bottom of the hoistway
H first distance
H second

What is claimed is:

1. An elevator system comprising:

a hoistway extending between a plurality of landings (8, 9);

at least one hoistway door allowing access to the hoistway;

an elevator car, which is configured to move along the hoistway;

at least one safety, which is attached to the elevator car and configured to stop any movement of the elevator car when activated;

an electronic safety actuator, which is configured to activate and deactivate the at least one safety; and a door safety switch, which is configured to monitor the at least one hoistway door, wherein the door safety switch is connected with the electronic safety actuator and configured to set the electronic safety actuator to an activated condition if the door safety switch detects that the at least one hoistway door is not closed, wherein in the activated condition the electronic safety actuator allows activating the at least one safety after the elevator car has stopped.

2. The elevator system according to claim 1, wherein the door safety switch is assigned to a hoistway door located at a lowest landing among the plurality of landings, wherein the door safety switch is configured to monitor the hoistway door located at the lowest landing.

3. The elevator system according to claim 1, wherein the electronic safety actuator is configured to allow releasing the at least one safety after it has been activated, for moving the elevator car along the hoistway in an inspection mode.

4. The elevator system according to claim 1, wherein the electronic safety actuator is configured to allow releasing the at least one safety after it has been activated for moving the elevator car only in a direction away from the at least one hoistway door.

5. The elevator system according to claim 1, comprising a pit at a lower portion of the hoistway and an inspection mode control unit located within the pit, wherein the electronic safety actuator is configured to allow controlling movement of the elevator car in an inspection mode by the inspection control unit.

6. An elevator system comprising:

a hoistway extending between a plurality of landings;

at least one hoistway door allowing access to the hoistway;

an elevator car, which is configured to move along the hoistway;

at least one safety, which is attached to the elevator car and configured to stop any movement of the elevator car when activated;

an electronic safety actuator, which is configured to activate and deactivate the at least one safety; and a door safety switch, which is configured to monitor the at least one hoistway door, wherein the door safety switch is connected with the electronic safety actuator and configured to set the electronic safety actuator to an activated condition if the door safety switch detects that the at least one hoistway door is not closed, wherein in the activated condition the electronic safety actuator allows activating the at least one safety according to a predefined condition;

further comprising a position sensor which is configured to detect the position of the elevator car within the hoistway, wherein the predefined condition is defined such that the electronic safety actuator is configured to activate the at least one safety after the elevator car has stopped, if the position sensor detects that a bottom of the elevator car is positioned outside the predetermined first distance (H1) from a bottom of the hoistway.

7. An elevator system comprising:

a hoistway extending between a plurality of landings;

at least one hoistway door allowing access to the hoistway;

an elevator car, which is configured to move along the hoistway;

at least one safety, which is attached to the elevator car and configured to stop any movement of the elevator car when activated;

an electronic safety actuator, which is configured to activate and deactivate the at least one safety; and a door safety switch, which is configured to monitor the at least one hoistway door, wherein the door safety switch is connected with the electronic safety actuator and configured to set the electronic safety actuator to an activated condition if the door safety switch detects that the at least one hoistway door is not closed, wherein in the activated condition the electronic safety actuator allows activating the at least one safety according to a predefined condition;

wherein the electronic safety actuator is configured to allow releasing the at least one safety after it has been activated for moving the elevator car only in a direction away from the at least one hoistway door;

wherein the electronic safety actuator is configured to also allow releasing the at least one safety for moving the elevator car in a direction towards the at least one hoistway door, after the at least one safety has been activated, if the position sensor detects that a bottom of the elevator car is positioned outside a predetermined second distance (H2) from a bottom of the hoistway, which is larger than the predetermined first distance (H1).

8. A method of operating an elevator system comprising:

a hoistway extending between a plurality of landings;

at least one hoistway door allowing access to the hoistway;

an elevator car, which is configured to move along the hoistway;

at least one safety, which is attached to the elevator car and configured to stop any movement of the elevator car, when activated;

an electronic safety actuator, which is configured to activate and deactivate the at least one safety;

a door safety switch, which is configured to monitor the at least one hoistway door and which is connected with the electronic safety actuator;

wherein the method includes:

monitoring the at least one hoistway door using the door safety switch; and activating the at least one safety after the elevator car has stopped, if the door safety switch detects that the at least one hoistway door is not closed.

9. The method according to claim 8, wherein the method includes releasing the at least one safety for moving the elevator car in an inspection mode; and controlling movement of the elevator car from an inspection control panel provided within a lower portion of the hoistway.

10. A method of operating an elevator system comprising:

a hoistway extending between a plurality of landings;

at least one hoistway door allowing access to the hoistway;

an elevator car, which is configured to move along the hoistway;

at least one safety, which is attached to the elevator car and configured to stop any movement of the elevator car, when activated;

an electronic safety actuator, which is configured to activate and deactivate the at least one safety;

a door safety switch, which is configured to monitor the at least one hoistway door and which is connected with the electronic safety actuator;

wherein the method includes:

monitoring the at least one hoistway door using the door safety switch; and activating the at least one safety, if the door safety switch detects that the at least one hoistway door is not closed;

wherein the method further includes detecting the current position of the elevator car; and activating the at least one safety after the elevator car has stopped, if the at least one hoistway door is not closed and a bottom of the elevator car is positioned outside the predetermined first distance (H1) from a bottom of the hoistway.

* * * * *